US006545233B2

(12) United States Patent
Takezawa

(10) Patent No.: US 6,545,233 B2
(45) Date of Patent: Apr. 8, 2003

(54) FOUR-DIRECTION SWITCH DEVICE

(75) Inventor: Keiji Takezawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/087,312

(22) Filed: Mar. 1, 2002

(65) Prior Publication Data

US 2002/0125112 A1 Sep. 12, 2002

(30) Foreign Application Priority Data

Mar. 6, 2001 (JP) ..... 2001-061467

(51) Int. Cl.[7] ..... H01H 25/04
(52) U.S. Cl. ..... 200/6 A; 200/5 R
(58) Field of Search ..... 200/4, 5 R, 6 A, 200/17 R, 18

(56) References Cited

U.S. PATENT DOCUMENTS 5,468,924 A * 11/1995 Naitou et al. ..... 200/6 A
5,691,517 A * 11/1997 Yamamoto et al. ..... 200/6 A
6,329,614 B1 * 12/2001 Miyashita ..... 200/5 R

* cited by examiner

*Primary Examiner*—Michael Friedhofer
(74) *Attorney, Agent, or Firm*—Brinks Hofer Gilson & Lione

(57) ABSTRACT

A four-direction switch device of the present invention comprises: a case; pushbutton switches housed in the case; and one operation member that is supported by the case to be tiltable in four directions of a cross shape and operates the pushbutton switches by tilt operations in the respective directions, wherein the operation member can tilt to first and second tilt positions that are opposite to each other with respect to a tilt center, and third and fourth tilt positions that are orthogonal to the first and second tilt positions and are opposite to each other with respect to the tilt center, and has operation power increasing means for producing greater operation power for a tilt to the fourth tilt position than for tilts to the first, second, and third tilt positions during tilt operations on the operation member.

6 Claims, 4 Drawing Sheets

FOUR-DIRECTION SWITCH DEVICE

BACKGROUND OF THE INVENTION

1. Field of the Invention

The present invention relates to a four-direction switch device suitably used for a vehicle keyless entry device.

2. Description of the Prior Art

Drawings of a conventional four-direction switch device are described below. FIG. 6 is a plan view showing a conventional four-direction switch device. FIG. 7 is a sectional view taken along the line 7—7 of FIG. 6.

A box-shaped upper case 51 made of a synthetic resin material has an upper wall 51*a*, a side wall 51*b* which is elongated almost vertically from an outer circumferential edge of the upper wall 51*a* and surrounds the switch device, and a through hole 51*c* provided at a nearly central portion of the upper wall 51*a*.

A holding member 52 made of a synthetic resin material is formed into the shape of a nearly square flat plate and four rectangular through holes 52*a* are formed in positions of a cross shape toward four outer circumferential sides from the central position of the holding member 52. The holding member 52 is fastened within the through hole 51*c* of the upper case by a proper means to block the through hole 51*c*.

Plural (four) operation knobs 53 made of a synthetic resin material are in the shape of a nearly rectangular flat plate, and on the surfaces of the respective operation knobs 53 are drawn icons 53*a* indicating specific operations such as a door open indication symbol, a door lock indication symbol, a trunk open indication symbol, and a panic operation indication symbol. The four operation knobs 53 are disposed within the four through holes 52*a*. The respective icons 53*a* are drawn one for each of the operation knobs 53. On the back of the operation knobs 53 is formed an engaging part 53*b* protruding outward.

An elastic cover 54 made of an elastic rubber material, which is similar to a dome in shape, has an upper wall 54*a*, a side wall 54*b* elongated curvedly from an outer circumferential edge of the upper wall 54*a* downward, flanges 54*c* protruded orthogonally to the side wall 54*b* from an open end thereof, four engaging parts 54*d* protruding from an outer surface of the upper wall 54*a* outward and provided in positions of a cross shape, and four pressing parts 54*e* protruding from an inner surface of the upper wall 54*a* inward and provided in positions respectively opposite to the four engaging parts 54*d*.

To the engaging parts 54*d* of the elastic cover 54, engaging parts 53*b* of the operation knobs 53 are coupled by such a proper means as snaps in a snap leg (not shown) provided on the engaging parts 54*d* in an indention (not shown) of the operation knobs 53. By this coupling, the operation knobs 53 are attached to the elastic cover 54.

A pushbutton switch 55 has a box-shaped housing 55*a* housing a movable contact (not shown), a fixed contact (not shown), and the like, and a pushbutton 55*b* provided protrusively from the upper surface of the housing 55*a* outward under pressure of the movable contact (not shown) and a spring member (not shown). Four of the pushbutton switches 55 are disposed, and the respective pushbuttons 55*b* of the pushbutton switches 55 have a nearly equal press operation power by dint of the movable contact (not shown) and the spring members (not shown).

The four pushbutton switches 55 are disposed opposite to the four pressing parts 54*e* of the elastic cover 54.

A printed wiring board 56 is in the shape of a nearly rectangle flat plate, and on the surface of the printed wiring board 56 is formed a required circuit pattern (not shown). On the printed wiring board 56 are disposed in positions of a cross shape the four pushbutton switches 55.

The printed wiring board 56 and the pushbutton switches 55 are housed within the elastic cover 54.

A box-shaped lower case 57 made of a synthetic resin material has a nearly rectangular bottom wall 57*a*, a side wall 57*b* which is elongated almost vertically from an outer circumferential edge of the bottom 57*a* and surrounds the switch device, and steps 57*c* provided at open ends of the side wall 57*b*. The lower case 57 and the upper case 51 are integrally incorporated with the flanges 54*c* of the elastic cover 54 being interposed therebetween.

Next, the operation of the conventional four-direction switch device is described.

First, when a required press power is applied to one operation knob 53 on which an icon 53*a* indicating a specific operation is drawn, the operation knob 53 is moved downward by the press power, and the elastic cover 54 is distorted at one location by the movement. By the pressing parts 54*e* of the distorted elastic cover 54, the pushbutton 55*b* of one pushbutton switch 55 is operated against a movable contact and a spring member and the pushbutton switch 55 goes on. During this operation, operation power by the moving contact and the spring member in one pushbutton switch 55 and operation power of the elastic cover 54 by distortion at one location together enable the operation knob 53 to be operated with a small press power.

When the press power to the operation knob 53 is removed, the operation knob 53 returns to its original position by the self-return force of the pushbutton 55*b* of the pushbutton switch 55 and the self-return force of the elastic cover 54, and the pushbutton switch 55 is turned off when the operation knob 53 returns to its original position.

When the operation knobs 53 on which the other three icons 53*a* are drawn are respectively applied with press power, the same operation as the above described operation in one pushbutton switch 53 is performed. Even by press power to any operation knob 53, the operation knob 53 can be operated with the same small press power by dint of operation power of one pushbutton switch 55 and operation power of the elastic cover 54 by distortion at one location. All press powers to the four operation knobs 53 are equalized.

In other words, in a normal condition, since press power of one pushbutton switch 55 operated by an operation knob 53 in which an icon 53*a* indicating the operation of a panic operation indication symbol is drawn is almost equal to press power of the pushbutton switches 55 respectively operated by the other three operation knobs 53 in which other icons 53*a* are drawn, the operation knob 53 in which the icon 53*a* indicating the operation of a panic operation indication symbol is drawn will be easily and carelessly operated.

As has been described above, in a conventional four-direction switch device, since press powers to the four operation knobs are almost equal, if an operation knob of panic operation is carelessly operated, such malfunctions that, for example, a horn is sounded or a light blinks are liable to occur.

SUMMARY OF THE INVENTION

The present invention provides a four-direction switch device that is almost free of careless operations on operation knobs thereof.

A four-direction switch device of the present invention comprises: a case; plural pushbutton switches housed in the case; and one operation member that is supported by the case to be tiltable in four directions and operates the pushbutton switches by tilt operations in the respective directions, wherein the operation member can tilt to first and second tilt positions that are opposite to each other with respect to a tilt center, and third and fourth tilt positions that are orthogonal to the first and second tilt positions and are opposite to each other with respect to the tilt center, and the operation member has an operation power increasing means for producing greater operation power for a tilt to the fourth tilt position than for tilts to the first, second, and third tilt positions during tilt operations on the operation member.

With the construction, since tilt operation power to one tilt position of the operation member is greater than tilt operation power to other three tilt positions, there is a difference in the magnitude of tilt operation power, so that a four-direction switch device almost free of careless operations can be provided which can explicitly tell the operator a tilt position requiring the great tilt operation power.

The four-direction switch device of the present invention has first, second, and third pushbutton switches operated by the operation member, wherein one pushbutton switch is operated in each of the first, second, and third tilt positions, wherein two of the pushbutton switches are operated in the fourth tilt position, and wherein the operation power increasing means is constituted by operation power with which the two pushbutton switches are operated.

With the construction, since the four-direction switch device can be configured with three pushbutton switches, the number of parts can be reduced and the inexpensive four-direction switch device having a simple construction can be provided in which the operation power increasing means is constituted by operation power with which the two pushbutton switches are operated.

In the four-direction switch device of the present invention, the first pushbutton switch is placed on a line passing through the tilt center at a side of the third tilt position, the second pushbutton switch is placed in a middle position between the first tilt position and the fourth tilt position, the third pushbutton switch is placed in a middle position between the second tilt position and the fourth tilt position, when the operation member is operated to tilt to the fourth tilt position, the two second and third pushbutton switches are operated at the same time, and the operation power increasing means is constituted by operation power with which the two second and third pushbutton switches are operated.

By this construction, a four-direction switch device can be provided which enables three pushbutton switches to be operated without fail.

In the four-direction switch device of the present invention, each pushbutton switch is constructed to operate by dint of pressure opposing a press of a spring movable contact or/and a press of a spring member energizing the pushbutton, and the operation power increasing means is constituted by the pressure against the two pushbutton switches.

By this construction, since the operation power increasing means has a simple construction, the number of parts can be reduced and an inexpensive four-direction switch device can be provided.

In the four-direction switch device of the present invention, an elastic cover made from rubber is disposed to cover the pushbutton switches between the operation member and the plural pushbutton switches, the pushbutton switches are operated via the elastic cover by tilting the operation member, and during a fourth tilt operation, the elastic cover is formed to distort in at least two locations which are opposite to two pushbutton switches, to use the distortion of the elastic cover as the operation power increasing means.

By this construction, since the operation power increasing means has a simple construction, the number of parts can be reduced and further an inexpensive four-direction switch device can be provided.

The four-direction switch device of the present invention is constructed so that a panic operation is performed by operating the operation member for the fourth tilt operation, which is provided with the operation power increasing means. With this construction, a four-direction switch device almost free of careless panic operations can be provided.

DESCRIPTION OF THE PREFERRED EMBODIMENTS

Figure 1:
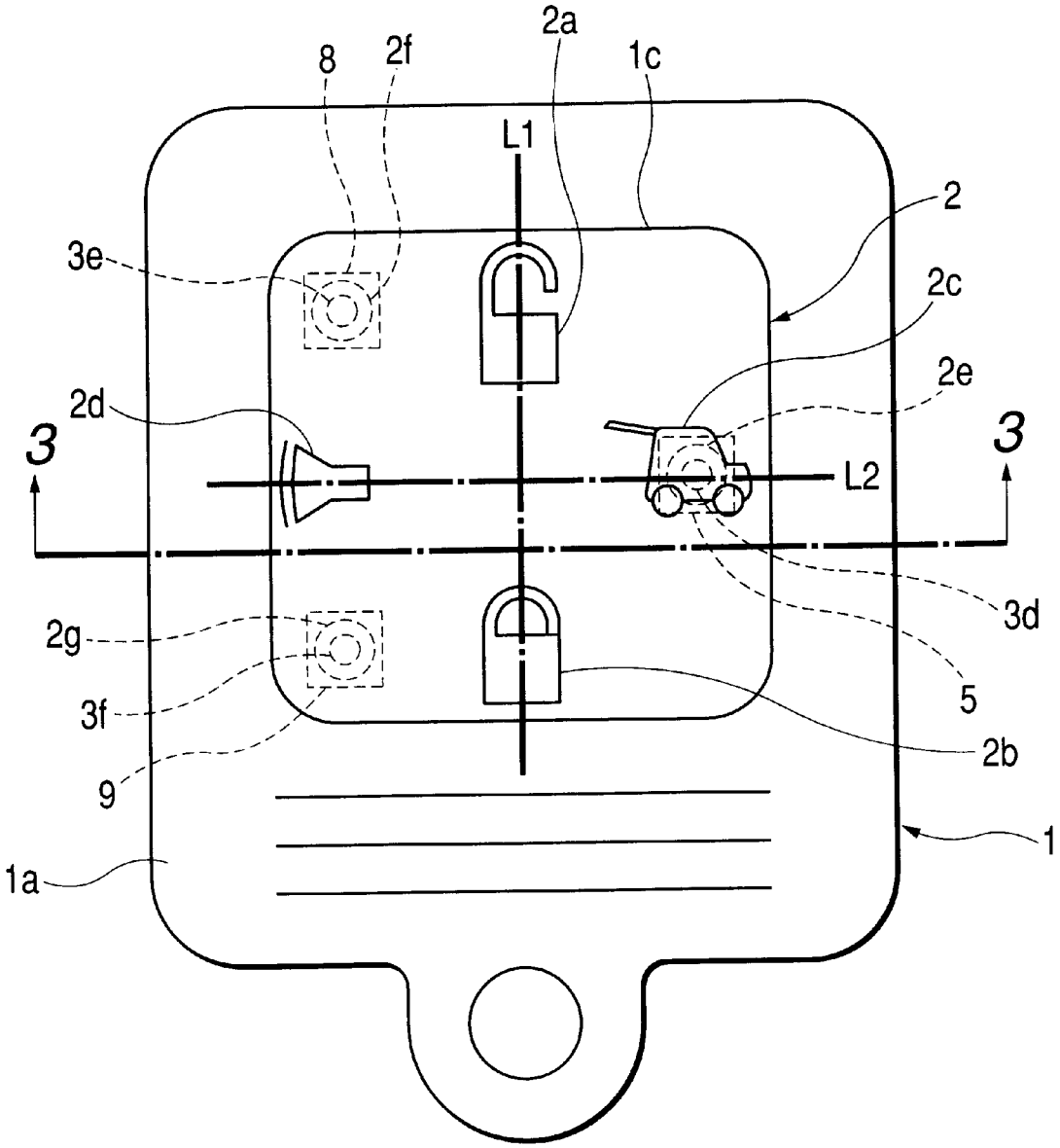
FIG. 1 is a plan view showing a four-direction switch device of the present invention.
Figure 2:
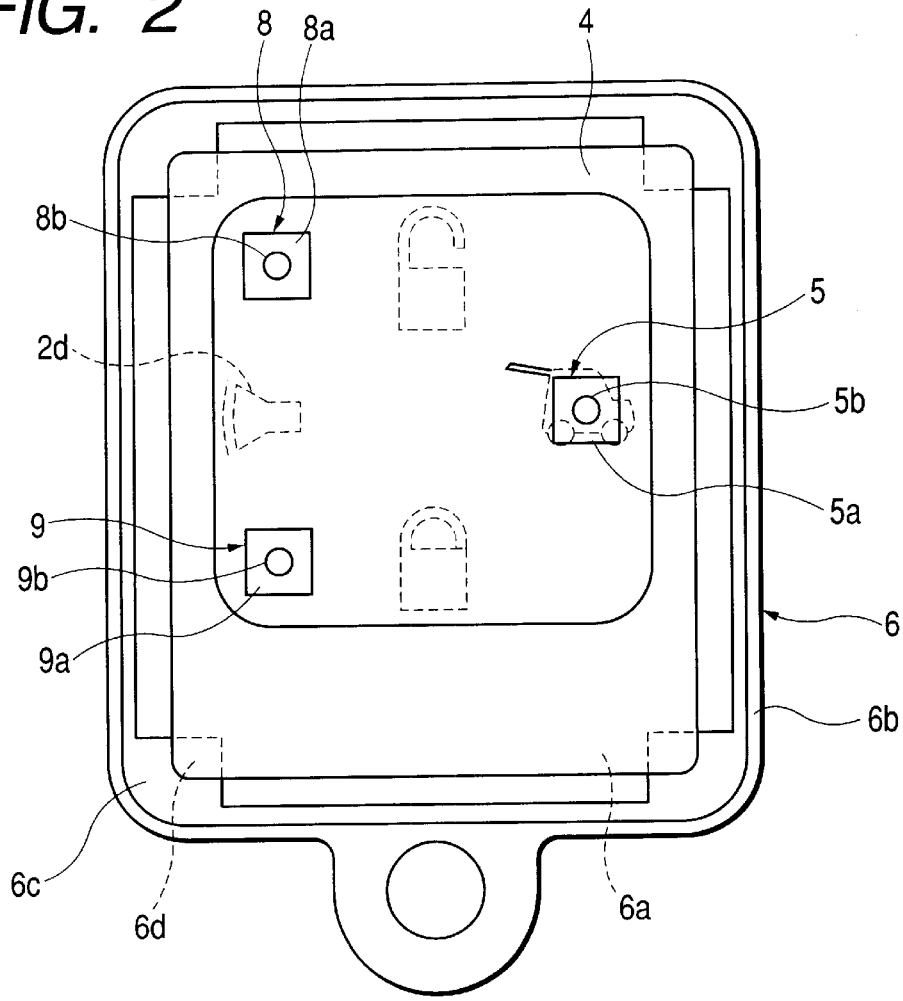
FIG. 2 relates to the four-direction switch device of the present invention and is a plan view showing a lower case, a printed wiring board, and pushbutton switches.
Figure 3:
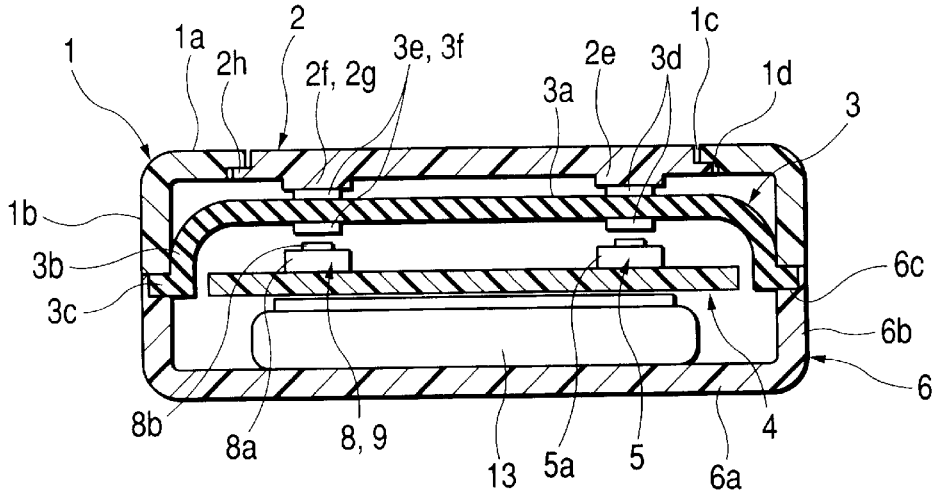
FIG. 3 is a sectional view taken along line 3—3 of FIG. 1.

The following explains drawings on the four-direction switch device of the present invention. FIG. 1 is a plan view showing the four-direction switch device of the present invention. FIG. 2 relates to the four-direction switch device of the present invention and is a plan view showing a lower case, a printed wiring board, and pushbutton switches. FIG. 3 is a sectional view taken along line 3—3 in FIG. 1.

A box-shaped upper case 1 made of a synthetic resin material has a flat upper wall 1*a*, a side wall 1*b* which is elongated almost vertically from an outer circumferential edge of the upper wall 1*a* and surrounds the switch device, a nearly square through hole 1*c* provided at a nearly central portion of the upper wall 1*a*, and step 1*d* provided in an inner circumferential edge of the through hole 1*c*.

A box-shaped lower case 6 made of a synthetic resin material has a flat bottom wall 6*a*, a side wall 6*b* which is elongated almost vertically from an outer circumferential edge of the bottom 6*a* and surrounds the switch device, steps 6*c* provided in inner circumferential edges of open ends of the side wall 6*b*, and holding parts 6*d* that are at four corners of the side wall 6*b* and respectively protrude from the vicinity of the steps 6*c* inward.

End faces of the side wall 1*b* of the upper case 1 are abutted on end faces of the side wall 6*b* of the lower case 6 to constitute one housing.

A printed wiring board 4 is in the shape of a nearly rectangle flat plate, and on the surface of the printed wiring board 4 is formed a required circuit pattern (not shown).

The printed wiring board 4 is mounted by a proper means with the four corners of the printed wiring board 4 being disposed on the holding parts 6*d* of the lower case 6 and is housed in the housing.

The first, second, and third pushbutton switches 5, 8, and 9 respectively have box-shaped housings 5*a*, 8*a*, an 9*a* housing a movable contact (not shown), a fixed contact (not shown), and the like, an pushbuttons 5*b*, 8*b*, and 9*b* provided protrusively from the upper surfaces of the housings 5*a*, 8*a*, and 9*a* outward under pressure of the movable contact (not shown) and a spring member (not shown) The first, second, and third pushbutton switches 5, 8, and 9 are connected to and mounted at predetermined locations on the printed wiring board 4 by a proper means such as soldering.

The first, second, and third pushbutton switches 5, 8, and 9 are constructed to operate by dint of pressure opposing a press of a spring movable contact (not shown) or/and a press of a spring member (not shown) energizing the pushbuttons 5*b*, 8*b*, and 9*b*. Therefore, the pushbuttons 5*b*, 8*b*, and 9*b* are operated vertically by dint of pressure opposing a press of the movable contact or/and a press of a spring member energizing the pushbuttons 5*b*, 8*b*, and 9*b*.

An elastic cover 3 made of an elastic rubber material, which is similar to a dome in shape, has a flat upper wall 3*a*, a side wall 3*b* elongated curvedly from an outer circumferential edge of the upper wall 3*a* downward, flanges 3*c* protruded orthogonally to the side wall 3*b* from an open end thereof, and first, second, and third pressing parts 3*d*, 3*e*, and 3*f* that respectively protrude outward and downward at opposite positions on an outer surface and an inner surface of the upper wall 3*a*, wherein the first, second, and third pressing parts 3*d*, 3*e*, and 3*f* are respectively placed at the vertexes of a rough triangle.

The elastic cover 3 is housed in the upper case 1, where the first, second, and third pressing parts 3*d*, 3*e*, and 3*f* are placed to be opposite to the first, second, and third pushbutton switches 5, 8, and 9.

The elastic cover 3 covers the printed wiring board 4, and the first, second, and third pushbutton switches 5, 8, and 9 housed therein.

When the first, second, and third pressing parts 3*d*, 3*e*, and 3*f* of the elastic cover 3 are distorted, the corresponding first, second, and third pushbutton switches 5, 8, and 9 are operated.

An operation member 2 made of a synthetic resin material, which is in the shape of a nearly square flat plate, has icons indicating specific operations, drawn in positions of a cross shape (four directions) on one face (surface) thereof. The icons include, for example, a first icon 2*a* indicating a door open indication symbol, a second icon 2*b* indicating a door lock indication symbol, a third icon 2*c* indicating a trunk open indication symbol, and a fourth icon 2*d* indicating a panic operation indication symbol.

The first icon 2*a* and the second icon 2*b* are placed to be opposite to each other on a first line L1 passing through the center of the operation member 2, and the third icon 2*c* and the fourth icon 2*d* are placed to be opposite to each other on a second line L2 that is orthogonal to the first line L1 and passes through the center of the operation member 2.

On another face (back) of the operation member 2 are formed: a first protrusion 2*e* that faces the third icon 2*c* and protrudes downward in the vicinity of one side of an outer circumferential edge of the operation member 2; a second protrusion 2*f* that protrudes downward in the vicinity of one corner of the outer circumferential edge of the operation member 2 between the first icon 2*a* and the fourth icon 2*d*; and a third protrusion 2*g* that protrudes downward in the vicinity of one corner of the outer circumferential edge of the operation member 2 between the second icon 2*b* and the fourth icon 2*d*.

In other words, the first, second, and third protrusions 2*e*, 2*f*, and 2*g* are placed to be respectively at the vertexes of a rough triangle, and are placed to be opposite to the first, second, and third pressing parts 3*d*, 3*e*, and 3*f* of the elastic cover 3. When the first, second, and third protrusions 2*e*, 2*f*, and 2*g* are operated downward in this state, the first, second, and third pressing parts 3*d*, 3*e*, and 3*f* of the elastic cover 3 are pressed by the first, second, and third protrusions 2*e*, 2*f*, and 2*g*.

A flange 2*h* surrounding the outer circumferential thereof is formed in an outer circumferential edge of the operation member 2. The operation member 2 is disposed in the through hole 1*c* of the upper case 1 so that the flange 2*h* of the operation member 2 is housed and supported in the step id provided in an inner circumferential edge of the through hole 1*c*. By this construction, the operation member 2 is supported by the upper case 1 to be tiltable in four directions of a cross shape and capable of tilt operations in individual directions.

The first, second, and third pushbutton switches 5, 8, and 9 on the printed wiring board 4 are placed to be opposite to the first, second, and third pressing parts 3*d*, 3*e*, and 3*f* of the elastic cover 3 so that the first, second, and third pressing parts 3*d*, 3*e*, and 3*f* can respectively operate the first, second, and third pushbutton switches 5, 8, and 9 by dint of a distortion operation of the elastic cover 3.

Specifically, the first pushbutton switch 5 is opposite to the first pressing part 3*d* of the elastic cover 3, the second pushbutton switch 8 is opposite to the first pressing part 3*e* of the elastic cover 3, and the third pushbutton switch 9 is opposite to the first pressing part 3*f* of the elastic cover 3.

That is, the first, second, and third pushbutton switches 5, 8, and 9 are disposed to be respectively opposite to the first, second, and third protrusions 2*e*, 2*f*, and 2*g* of the operation member 2.

The flange 3*c* of the elastic cover 3 is mounted on the steps 6*c* of the side wall 6*b* of the lower case 6, and the side wall 1*b* of the upper case 1 is placed on the side wall 6*b* of the lower case 6 with the flanges 3*c* of the elastic cover 3 sandwiched between the side wall 1*b* and the steps 6*c*. Thereby, the elastic cover 3 is housed within the upper and lower cases 1 and 6 in such a manner that the upper case 1 and the lower case 6 sandwich the elastic cover 3.

A button battery 13 has a specified voltage value and is housed in the lower case 6.

The operation of the four-direction switch device of the present invention is described.

As a first tilt operation, when the first icon 2*a* (first tilt position) indicating a door open indication symbol drawn on the operation member 2 is pressed, the operation member 2 is tilted in a direction of the first icon 2*a* with respect to a tilt center. By this tilt operation, the second protrusion 2*f* of the operation member 2 operates the second pushbutton switch 8 via the second pressing part 3*e* of the elastic cover 3. The tilt operation power at this time is operation power caused by distortion at one location of the elastic cover 3 and pressure opposing a press of a spring movable contact (not shown) of the second pushbutton switch 8 or/and a press of a spring member (not shown) energizing the pushbutton 8*b*. The operation member 2 is tilted by the small tilt operation power.

When the press to the first icon 2*a* is removed, the operation member 2 returns to its original position parallel to the upper case 1 by pressure opposing the press of the spring movable contact (not shown) of the second pushbutton switch 8 or/and the press of the spring member (not shown) energizing the pushbutton 8*b*, and a self-return force of the elastic cover 3.

As a second tilt operation, when the second icon 2*b* (second tilt position) indicating a door lock indication symbol drawn on the operation member 2 is pressed, the operation member 2 is tilted in a direction of the second icon 2*b*.

By this tilt operation, the third protrusion 2*g* of the operation member 2 operates the third pushbutton switch 9 via the third pressing part 3*f* of the elastic cover 3. The tilt operation power at this time is operation power caused by distortion at one location of the elastic cover 3 and pressure opposing a press of a spring movable contact (not shown) of the third pushbutton switch 9 or/and a press of a spring member (not shown) energizing the pushbutton 9*b*. The operation member 2 is tilted by the small tilt operation power.

When the press to the second icon 2*b* is removed, the operation member 2 returns to its original position parallel to the upper case 1 as in the case with the first icon 2*a*.

As a third tilt operation, when the third icon 2*c* (third tilt position) indicating a trunk open indication symbol drawn on the operation member 2 is pressed, the operation member 2 is tilted in a direction of the third icon 2*c*.

By this tilt operation, the first protrusion 2*e* of the operation member 2 operates the first pushbutton switch 5 via the first pressing part 3*d* of the elastic cover 3. The tilt operation power at this time is operation power caused by distortion at one location of the elastic cover 3 and pressure opposing a press of a spring movable contact (not shown) of the first pushbutton switch 5 or/and a press of a spring member (not shown) energizing the pushbutton 5*b*. The operation member 2 is tilted by the small tilt operation power as are the above described cases.

When the press to the third icon 2*c* is removed, the operation member 2 returns to its original position parallel to the upper case 1 as in the case with the first icon 2*a*.

As a fourth tilt operation, when the fourth icon 2*d* (fourth tilt position) indicating a panic operation indication symbol drawn on the operation member 2 is pressed, the operation member 2 is tilted in a direction of the fourth icon 2*d*.

By this tilt operation, the second protrusion 2*f* and the third protrusion 2*g* of the operation member 2 operate the two pushbuttons switches, the second pushbutton switch 8 and the third pushbutton switch 9 at the same time via the second pressing part 3*e* and the third pressing part 3*f* of the elastic cover 3. The tilt operation power at this time is operation power caused by distortion at two locations of the elastic cover 3 and pressure opposing a press of the spring movable contacts (not shown) of the second and third pushbutton switches 8 and 9 or/and a press of the spring members (not shown) energizing the pushbutton buttons 8*b* and 9*b*. The operation member 2 is tilted by the great tilt operation power.

That is, the tilt operation power in the fourth tilt operation is greater than the tilt operation power in the first, second, and third tilt operations, and an operation power increasing means is constituted by distortion in two locations of the elastic cover 3, and the second and third pushbutton switches 8 and 9.

In other words, the four-direction switch device is constructed so that the fourth tilt operation of the operation member 2 for panic operation requires greater tilt operation power than the tilt operation power in the above described first, second, and third tilt operations, to prevent careless fourth tilt operations.

When the press to the fourth icon 2*c* is removed, the operation member 2 returns to its original position parallel to the upper case 1 as in the case with the first icon 2*a*. Thus, the four-direction switch device is constructed to be capable of tilt operations in four directions and a return operation.

Figure 4:
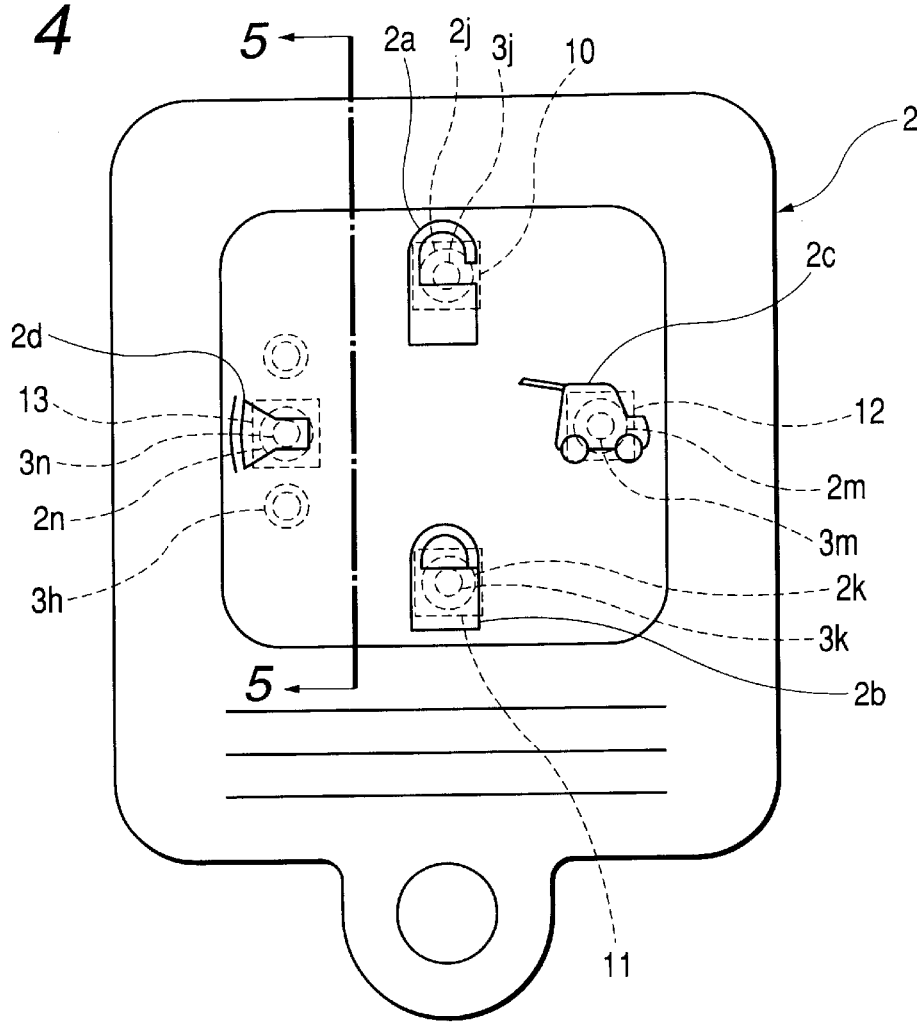
FIG. 4 is a plan view showing a second embodiment of the four-direction switch device of the present invention.
Figure 5:
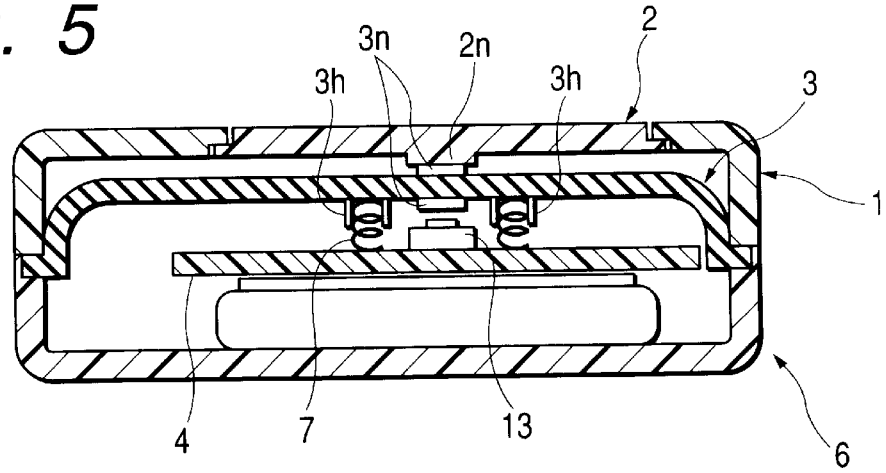
FIG. 5 is a sectional view taken along the line 5—5 of FIG. 4.
Figure 6:
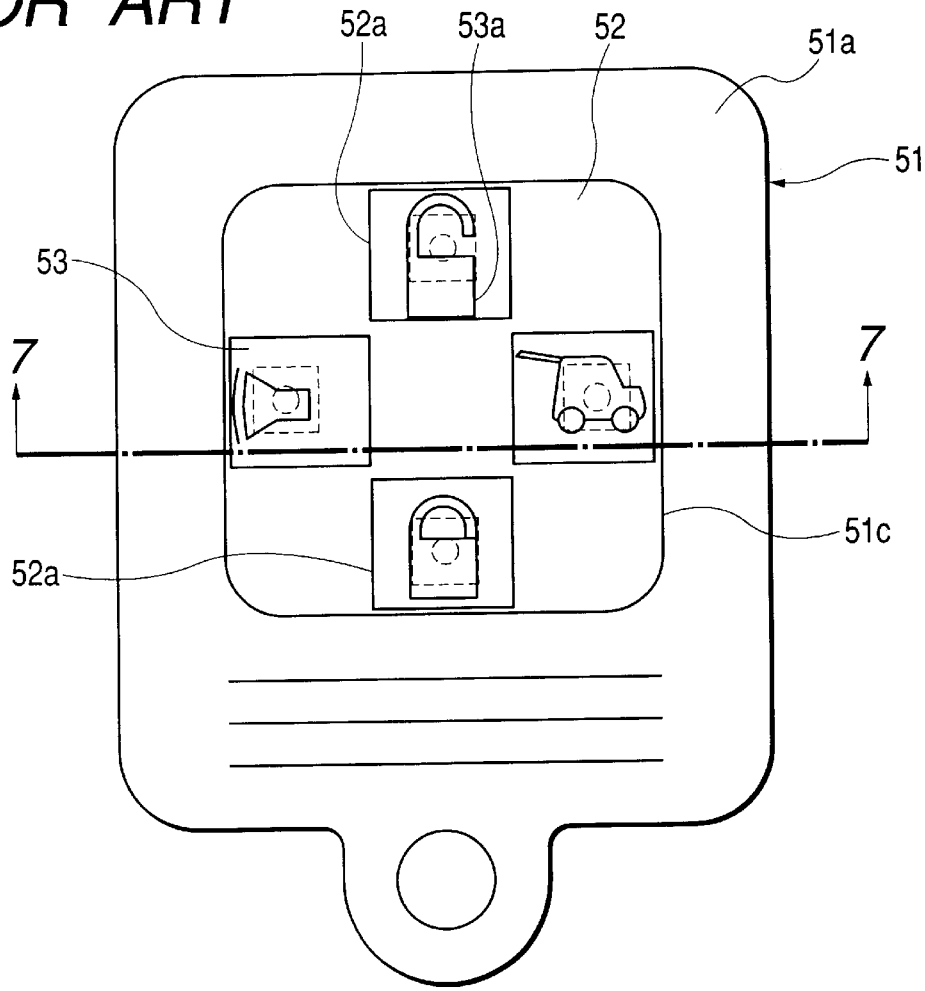
FIG. 6 PRIOR ART
FIG. 6 is a plan view showing a conventional four-direction switch device.
Figure 7:
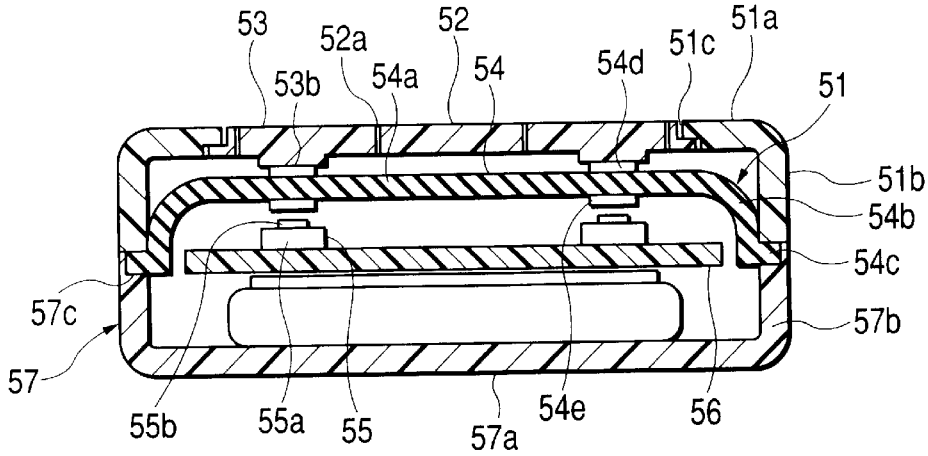
FIG. 7 PRIOR ART
FIG. 7 is a sectional view taken along the line 7—7 of FIG. 6.

The following explains drawings on a second embodiment of the four-direction switch device of the present invention. FIG. 4 is a plan view showing a second embodiment of the four-direction switch device of the present invention. FIG. 5 is a sectional view taken along the line 5—5 of FIG. 4.

It is understood that components identical to components of the four-direction switch device of the first embodiment are identified by the same reference numerals, and a description of them is omitted.

Hereinafter, a description is made of differences between the second and first embodiments of the four-direction switch device.

An operation member 2 has first, second, third, and fourth protrusions 2*j*, 2*k*, 2*m*, and 2*n* respectively formed at positions on a back face thereof that are opposite to first, second, third, and fourth icons 2*a*, 2*b*, 2*c*, and 2*d*.

An elastic cover 3 has first, second, third, and fourth pressing parts 3*j*, 3*k*, 3*m*, and 3*n* respectively formed at positions that are opposite to the first, second, third, and fourth protrusions 2*j*, 2*k*, 2*m*, and 2*n* of the operation member 2. A pair of nearly cylindrical tubes 3*h* are formed at opposite positions with the fourth pressing part 3*n* sandwiched.

First, second, third, and fourth pushbutton switches 10, 11, 12, and 13 are mounted on a printed wiring board 4 by a proper means such as soldering at four locations thereof that are respectively opposite to the first, second, third, and fourth pressing parts 3*j*, 3*k*, 3*m*, and 3*n* of the elastic cover 3.

The fourth pushbutton switch 13 is disposed to be opposite to the fourth icon 2*d* indicating a panic operation indication symbol.

Elastic coil springs 7, spirally formed, are placed within the tubes 3*h* of the elastic cover 3 and elastically pressed between the elastic cover 3 and the printed wiring board 4.

That is, the elastic coil spring 7 is placed in the vicinity of the fourth icon 2*d* for panic operation so that, when a position of the operation member 2 in which the fourth icon 2*d* is drawn is pressed, the operation member 2 is tilted in a direction of the fourth icon 2*d*, and the tilt operation causes the elastic cover 3 to be pressed against elastic force of the elastic coil spring 7. This means that the operation member 2 is tilted with a great tilt operation power.

The tilt operation power in the fourth tilt operation requires greater tilt operation power than the tilt operation power in the above described first, second, and third tilt operations because other tilt operations would not operate the elastic coil spring 7. An operation power increasing means is constituted by the two elastic coil springs 7.

When the press to the fourth icon 2*d* is removed, the operation member 2 returns to its original position parallel to the upper case 1 as in the case with the first icon 2*a*. Thus, the four-direction switch device is constructed to be capable of tilt operations in four directions and a return operation.

Although, in the first embodiment, the operation power increasing means is constituted by distortion in two locations of the elastic cover and the operation power to operate two pushbutton switches, the present invention is not limited to this configuration, and only distortion operation of the elastic cover or only press operation of two pushbutton switches may be used as the operation power increasing means.

Although, in the second embodiment, two elastic coil springs are used to constitute the operation power increasing means, the present invention is not limited to this configuration, and one elastic coil spring may be used or an elastic member may be placed.

In the four-direction switch device of the present invention, the operation member can tilt to first and second tilt positions that are opposite to each other with respect to a tilt center, and third and fourth tilt positions that are orthogonal to the first and second tilt positions and are opposite to each other with respect to the tilt center, and has an operation power increasing means for producing greater operation power for a tilt to the fourth tilt position than for tilts to the first, second, and third tilt positions during tilt operations on the operation member. With the construction, since tilt operation power to one tilt position of the operation member is grater than tilt operation power to other three tilt positions, there is a difference in the magnitude of tilt operation power, so that a four-direction switch device almost free of careless operations can be provided which can explicitly tell the operator a tilt position requiring the great tilt operation power.

The four-direction switch device of the present invention has first, second, and third pushbutton switches operated by the operation member, wherein one pushbutton switch is operated in each of the first, second, and third tilt positions, two of the pushbutton switches are operated in the fourth tilt position, and the operation power increasing means is constituted by operation power with which the two pushbutton switches are operated. With the construction, since the four-direction switch device can be configured with three pushbutton switches, the number of parts can be reduced and the inexpensive four-direction switch device can be provided in which the operation power increasing means is constituted by operation power with which the two pushbutton switches are operated.

The four-direction switch device of the present invention is constructed so that a panic operation is performed by operating the operation member for the fourth tilt operation, which is provided with the operation power increasing means. With this construction, a four-direction switch device almost free of careless panic operations can be provided.

What is claimed is:

1. A four-direction switch device, comprising:

a case;

plural pushbutton switches housed in the case; and one operation member that is supported by the case to be tiltable in four directions and operates the pushbutton switches by tilt operations in the respective directions, wherein the operation member tilts to first and second tilt positions that are opposite to each other with respect to a tilt center, and third and fourth tilt positions that are orthogonal to the first and second tilt positions and are opposite to each other with respect to the tilt center, and wherein the operation member has an opera power mechanism to increase operation power for a tilt to the fourth tilt position with respect to tilts to the first, second, and third tilt positions during tilt operations on the operation member.

2. The four-direction switch device according to claim 1 which has first, second, and third pushbutton switches operated by the operation member, wherein one of the pushbutton switches is operated in each of the first, second, and third tilt positions, wherein two of the pushbutton switches are operated in the fourth tilt position, and wherein the operation power increasing mechanism increases the operation power to an operation power with which the two of the pushbutton switches are operated.

3. The four-direction switch device according to claim 2, wherein the first pushbutton switch is disposed on a line passing through the tilt center at a side of the third tilt position, wherein the second pushbutton switch is disposed in a middle position between the first tilt position and the fourth tilt position, wherein the third pushbutton switch is disposed in a middle position between the second tilt position and the fourth tilt position, wherein when the operation member is operated to tilt to the fourth tilt position, the second and third pushbutton switches are operated at the same time, and wherein the operation power increasing mechanism is operated by operation power with which the second and third pushbutton switches are operated.

4. The four-direction switch device according to claim 2, wherein each of the pushbutton switches operates by dint of pressure opposing at least one of a press of a spring movable contact and a press of a spring member energizing the pushbutton, and wherein the operation power increasing mechanism is operated by the pressure against the two of the pushbutton switches.

5. The four-direction switch device according to claim 2, wherein an elastic cover comprised of rubber is disposed to cover the pushbutton switches between the operation member and the plural pushbutton switches, wherein the pushbutton switches are operated via the elastic cover by tilting the operation member, and wherein during a fourth tilt operation, the elastic cover distorts in at least two locations which are opposite to the two of the pushbutton switches, to use the distortion of the elastic cover as the operation power increasing mechanism.

6. The four-direction switch device according to claim 1, wherein a panic operation is performed by operating the operation member to the fourth tilt operation, which is provided with the operation power increasing mechanism.

* * * * *

UNITED STATES PATENT AND TRADEMARK OFFICE

CERTIFICATE OF CORRECTION

PATENT NO. : 6,545,233 B2
APPLICATION NO. : 10/087312
DATED : April 8, 2003
INVENTOR(S) : Keiji Takezawa It is certified that error appears in the above-identified patent and that said Letters Patent is hereby corrected as shown below:

In the Claims

In claim 1, line 12, delete "opera" and substitute --operation-- in its place.

In claim 6, line 3, delete "operation," and substitute --position,-- in its place.

Signed and Sealed this

Twenty-ninth Day of August, 2006

JON W. DUDAS
*Director of the United States Patent and Trademark Office*